US007306036B2

(12) United States Patent
Breglio, III et al.

(10) Patent No.: US 7,306,036 B2
(45) Date of Patent: Dec. 11, 2007

(54) SYSTEM FOR REDUCING ADHESION AND COHESION BETWEEN NON METALLIC BAILERS AND SIDE WALL OF WELLS

(76) Inventors: Robert A. Breglio, III, 1116 Delight Way, Escondido, CA (US) 92026; Gregory Alyanakian, 7409 Durfee Rd., Sacramento, CA (US) 95831; Rodney N. Reeve, 2843 Sumac Rd., Fallbrook, CA (US) 92028

( * ) Notice: Subject to any disclaimer, the term of this patent is extended or adjusted under 35 U.S.C. 154(b) by 53 days.

(21) Appl. No.: 10/865,650

(22) Filed: Jun. 10, 2004

(65) Prior Publication Data

US 2005/0274509 A1 Dec. 15, 2005

(51) Int. Cl.
*E21B 49/08* (2006.01)
*G01N 1/12* (2006.01)

(52) U.S. Cl. ..... 166/264; 166/162; 166/241.6; 73/864.63

(58) Field of Classification Search ..... 166/69, 166/162, 241.6, 264, 311; 73/864.51, 864.63
See application file for complete search history.

(56) References Cited

U.S. PATENT DOCUMENTS

| | | | | |
|---|---|---|---|---|
| 400,896 | A | 4/1889 | Burkellow | |
| 1,204,105 | A | 11/1916 | Wiley | |
| 1,489,986 | A | 4/1924 | Davison | |
| 1,763,703 | A | 6/1930 | Hinderliter | |
| 1,937,707 | A | 12/1933 | McDowell | |
| 2,143,836 | A | 1/1939 | Anderson | |
| 2,155,601 | A | 4/1939 | Johnson | |
| 2,160,320 | A * | 5/1939 | Walker | 166/166 |
| 2,345,219 | A | 3/1944 | Sanderson | |
| 2,438,298 | A | 3/1948 | Reed | |
| 2,572,493 | A | 10/1951 | Klaasen et al. | |
| 5,349,875 | A * | 9/1994 | Sher et al. | 73/864.65 |
| 5,404,949 | A | 4/1995 | Voss | |
| 5,507,194 | A | 4/1996 | Scavuzzo et al. | |
| 5,597,966 | A | 1/1997 | Timmons | |
| 5,753,831 | A | 5/1998 | Mohs | |
| 5,878,813 | A | 3/1999 | Ridgeway, Jr. | |
| 5,902,940 | A | 5/1999 | Stern | |
| 6,276,220 | B1 | 8/2001 | Varhol | |

(Continued)

*Primary Examiner*—David Bagnell
*Assistant Examiner*—Shane Bomar
(74) *Attorney, Agent, or Firm*—Knobbe Martens Olson & Bear, LLP

(57) ABSTRACT

A water well bailer. In one embodiment, the bailer includes a tubular housing composed of any polymer used as a plastic, such as, polyethylene, polypropylene, polystyrene, polyesters, polycarbonate, polyvinyl chloride, nylon, poly (methyl methacrylate), polytetrafluoride, polyacrylonitrile, or chemical derivations there of for storing within the housing a sample of well water. A texture may be on the housing. The texture of the bailer reduces the surface area of the bailer in contact with the inside wall of a water well such that the bailer does not stick to the wall of the water well during incidental contact. The reason a bailer sticks to the side of a well is due to adhesive and cohesive forces acting between the well wall and the bailer. Adhesive and cohesive forces are generated between the bailer and well wall because of humidity and condensation of water on the well wall, and water on the outside of the bailer after initial contact with groundwater. Due to the low-density (light weight) nature of these bailers, adhesive and cohesive forces are able to overcome the force of gravity thus impeding the descent of the bailer.

28 Claims, 3 Drawing Sheets

U.S. PATENT DOCUMENTS 6,431,272 B1 8/2002 Pratt
6,439,304 B2 * 8/2002 Eaton ..... 166/241.6
6,464,012 B1 * 10/2002 Strickland ..... 166/369
6,481,300 B1 11/2002 Cordry
6,543,302 B1 4/2003 Pratt
6,669,255 B2 * 12/2003 Pratt ..... 294/68.25

* cited by examiner

SYSTEM FOR REDUCING ADHESION AND COHESION BETWEEN NON METALLIC BAILERS AND SIDE WALL OF WELLS

BACKGROUND OF THE INVENTION

1. Field of the Invention

The field of the invention relates to water well bailers.

2. Description of the Related Technology

Bailers, i.e., fluid sampling apparatuses, are typically elongated tubular bodies having hollow interiors and a type of valve to contain a fluid after it has entered the bailer. The purpose of the bailer is to retrieve water from a water well (which term includes groundwater monitoring well, supply well, or irrigation well). FIG. 1 illustrates an exemplary plastic bailer that may be used to extract well water.

One problem that has been identified with low-density (non-metallic) type bailers is that these types of bailers stick to the side of a well due to adhesive and cohesive forces acting between the well wall and the bailer. Adhesive and cohesive forces are generated between the bailer and well wall because of humidity and condensation of water on the well wall, and water on the outside of the bailer after initial contact with groundwater. Due to the low-density (light weight) nature of these bailers, adhesive and cohesive forces are able to overcome the force of gravity thus impeding the descent of the bailer Thus, there is a need for an improved bailer.

SUMMARY OF THE INVENTION

One aspect of a system comprises a water well bailer. In this aspect, the bailer comprises: a tubular housing composed at least in part of a polymer, which includes copolymers, used as a rubber, resin, or plastic, such as, polyethylene, polypropylene, polystyrene, polyester, polycarbonate, polyvinyl chloride, nylon, poly(methyl methacrylate), polytetrafluoride, polyacrylonitrile, or chemical derivations thereof, the housing adapted to store a sample of well water; and a texture on the housing, wherein the texture of the bailer provides a surface area of the bailer that does not stick to a wall of a water well during incidental contact during descent of the bailer in the water well.

Another aspect comprises a water well bailer, comprising: a non-metallic tubular housing configured to store within the housing a sample of well water; and at least one ring concentrically surrounding at least a portion of the tubular housing, the ring being configured to prevent a substantial portion of the outer surface of the housing from contacting a side of a water well during use.

Another aspect comprises a water well bailer, the bailer, comprising: a non-metallic tubular housing configured to store within the housing a sample of well water; and a plurality of sparsely positioned spherical protrusions which are configured to prevent a substantial portion of the outer surface of the housing from contacting a side of a water well during use.

Another aspect comprises a water well bailer, comprising: a non-metallic tubular housing for storing within the housing a sample of well water; and at least three running rails which extend along the length of the housing and which are configured to prevent a substantial portion of the outer surface of the housing from contacting a side of a water well during use.

Another aspect comprises a method of modifying a well water bailer, the method comprising: providing a non-metallic tubular housing configured to store within the housing a sample of well water; and concentrically affixing at least one ring to at least a portion of the tubular housing, the ring being configured to prevent a substantial portion of the outer surface of the housing from contacting a side of a well during use.

Another aspect comprises a water well bailer, comprising: a tubular housing configured to store within the housing a sample of well water, the housing being manufactured from a material selected from the group comprising: a polymer, such as a rubber, resin or plastic; and a composite material, such as polyester or epoxy, filled or reinforced with various fibers; and at least one ring concentrically surrounding at least a portion of the tubular housing, the ring being configured to prevent a substantial portion of the outer surface of the housing from contacting a side of a well during use.

Another aspect comprise a water well bailer, comprising: a non-metallic tubular housing for storing within the housing a sample of well water; and a plurality of depressions within an outer surface of the housing, the depressions collectively forming at least 10% of a surface of the bailer.

Another aspect comprises a water well bailer, comprising: a non-metallic and low-density tubular housing for storing within the housing a sample of well water; and a texture on the housing, wherein texture of the housing provides a surface of the bailer such the bailer does not stick to the wall because during descent the adhesive and cohesive forces acting between the bailer and well wall are not greater than the gravitational forces acting upon the bailer.

Another aspect comprises a water well bailer, comprising: a tubular housing composed a low-density, non-cellulosic, and non-metallic material for storing within the housing a sample of well water; and a texture on the housing, wherein texture of the bailer provides a surface area of the bailer that does not stick to a wall of a water well during incidental contact during descent of the bailer in the water well.

DETAILED DESCRIPTION OF CERTAIN EMBODIMENTS OF THE INVENTION

Figure 1:
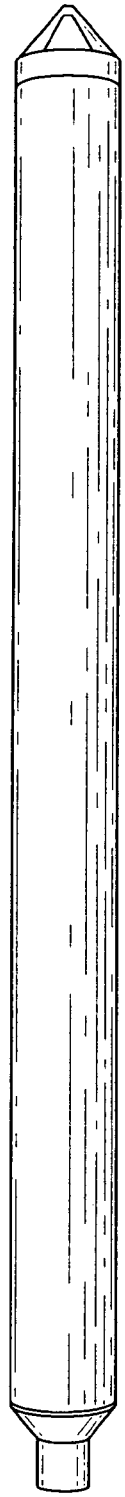
Prior Art FIG. 1
FIG. 1 is an elevation view of an exemplary plastic prior art bailer.

The following detailed description is directed to certain specific embodiments of the invention. However, the invention can be embodied in a multitude of different ways as defined and covered by the claims. In this description, reference is made to the drawings wherein like parts are designated with like numerals throughout.

In one embodiment, a textured bailer is provided that provides a surface that reduces the likelihood that the bailer will become stuck inside a well during use. Depending on the embodiment, the bailer may be manufactured from one or more or a composition thereof of the following materials: polymers (which term includes copolymers) such as rubbers, resins and plastics. Rubbers can include natural rubber, polyisoprenes, polybutadienes, polychloroprenes, silicon rubbers, and styrene-butadiene rubbers (SBR). Resins can include crosslinked materials such as phenolic resins, amino resins, polyester resins and epoxy resins. Plastics include thermoplastics such as polyethylenes, polypropylenes, polybutenes, acrylics, methacrylics, polyvinylchloride (PVC), polystyrenes, polyvinylesters, polyamides, polyurethanes, polyesters, nylons, poly(methyl methacrylate), polytetrafluoride, polyacrylonitrile, polysulfones, acrylonitrile-butadiene-styrene (ABS), polycarbonates, polyimides, and various fluorinated polymers such as polytetrafluroethylene. Composite materials can include various polymers (including polyester and epoxy) filled or reinforced with various fibers (such as carbon and glass).

In one embodiment, the texture of the bailer provides a space or gap between a "substantial portion" of the bailer and the inside wall of a well. By providing the space or gap, the amount of surface area that is in contact between the body of the bailer and the inside wall of the well is reduced when compared to a bailer that has a smooth, substantially cylindrical and uniform surface. The reduced surface area will allow for a bailer made of one or more of the above-materials to overcome the cohesive and adhesive forces between the body of the bailer and well wall when the bailer and the well wall are wet. In one embodiment, the "substantial portion" is at least 50% of the surface of the bailer. In other embodiments, the substantial portion includes at least the following percentages of the surface of the bailer: 60%, 70%, 80%, 90%, and 99%. In general, the larger the percentage of the surface of the bailer that could not come in contact with a side wall of a well, the less likely it is that the bailer will stick when the bailer comes in contact with the well wall.

In one embodiment, the distance between the outer most point of an external feature to the outer most point of an external feature on the opposite side of the bailer, in a direction through the bailer, should not exceed four inches. Thus, in one embodiment, the diameter of the bailer is no larger than four inches. In another embodiment, the diameter of the bailer is between three to five inches. In yet another embodiment, the diameter of the bailer is between 0.5 to 10 inches.

In certain embodiments, the bailer may have one or more of the following features. In one embodiment, the bailer has external features or shapes, i.e., the texture, on the outer body of the bailer that causes the bailer when it is in contact with the wall of a well to be offset from the wall at the point of the texture. This reduces the surface area in contact between the bailer and well wall and thereby reduces any potential adhesive and cohesive forces that develop when the bailer contacts the wall during descent. The texture of the bailer may include any geometric pattern, shape, design, or texture. These external features can include, but are not limited to: rings, bands, runners, rails, dots, bumps, or protrusions. The texture can be configured in any manner along or around the body of the bailer in as such as they cause at least one point of the body of the bailer to be offset from the well wall when the bailer and well wall are in contact.

Figure 2:
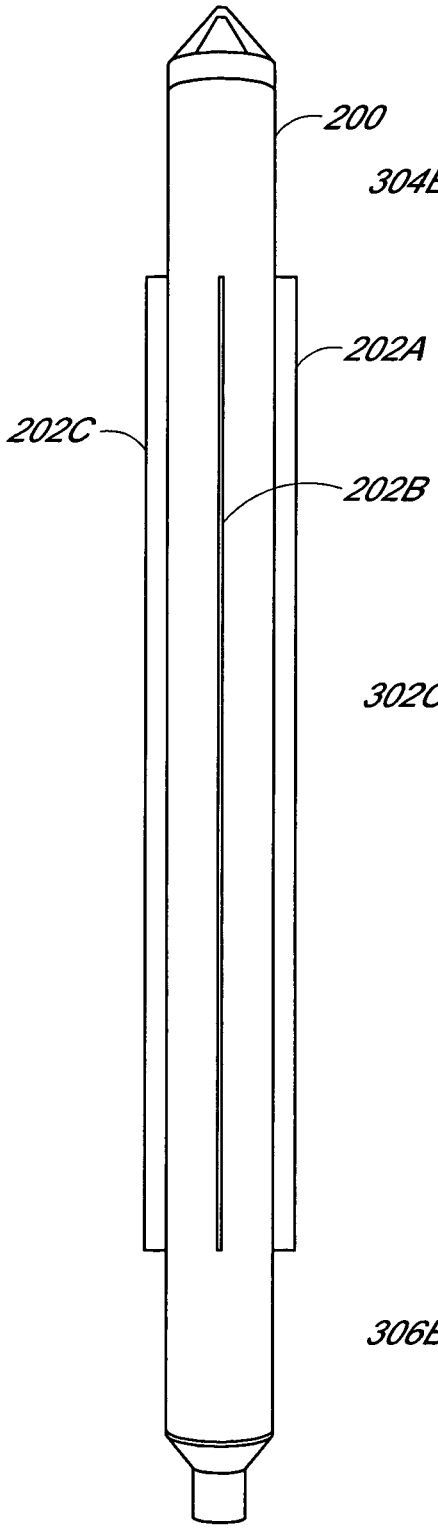
FIG. 2 is an elevation view of a bailer according to one embodiment of the invention that has a plurality of runners.

FIG. 2 is an elevational view of a bailer 200 having running rails 202A, 202B, and 202C. It is to be appreciated that not shown on the bailer 200 is a running rail that is positioned opposite to running 202B that is similar in size and shape to the running rails 202A, 202B, and 202C. As is shown, the running rails 202A, 202B, and 202C extend and are parallel to the length of the bailer 200. The length of the running rails 202A, 202B, and 202C may be reduced or lengthened so long as they cause a substantial portion of the bailer 200 from contacting a well wall during use. In one embodiment, depending on the embodiment, fewer or additional running rails may be included on the bailer. The number of running rails is dependent on the height of the running rails. The spacing between the running rails and the height of the running rails should be such as to not allow the arc of the bailer between the runners to be higher than the runners.

Although FIG. 2 illustrates running rails that are substantially rectangular in shape in cross section, other configurations of running rails may be used such as non-limiting examples: cylindrical, pyramidal, and trapezoidal in cross section. The running rails may be integrated with the bailer 200 during manufacture or affixed after the manufacture of the bailer 200.

Figure 3:
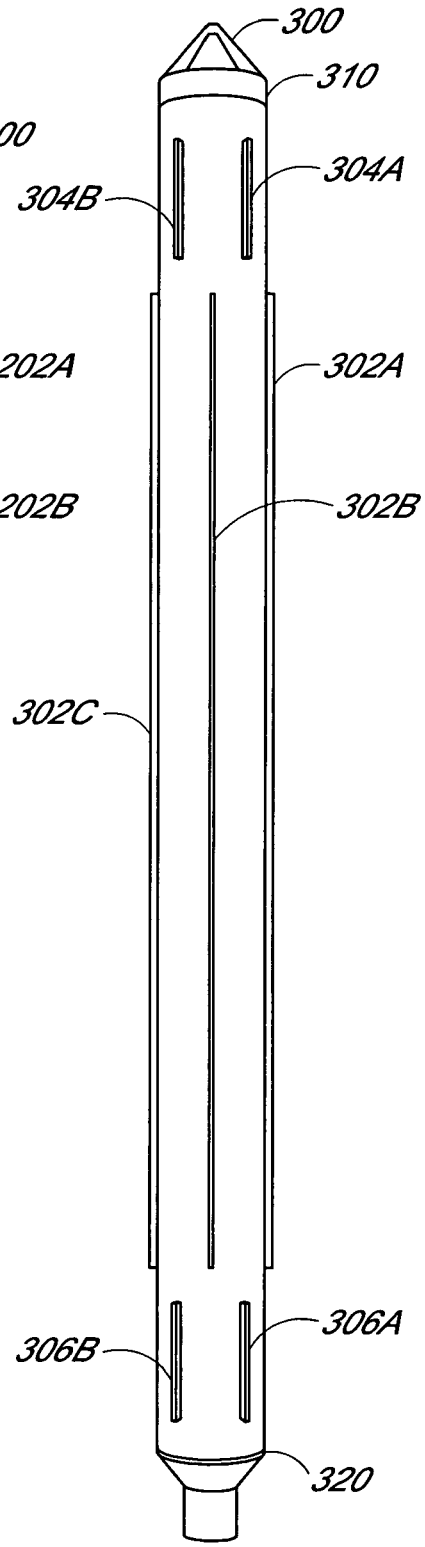
FIG. 3 is an elevation view of a bailer according to one embodiment of the invention that has a plurality of runners.

FIG. 3 is an elevational view of a bailer 300. It is to be appreciated that not shown on the bailer 300 is a running rail that is positioned opposite to running 302B and that is similar in size and shape to the running rails 302A, 302B, and 302C. As is shown, the running rails 302A, 302B, and 302C extend and are parallel to the length of the bailer 200. The length of the running rails 302A, 302B, and 302C may be reduced or lengthened so long as they cause a substantial portion of the bailer 300 from contacting a well wall during use. Positioned between the running rails 302A, 302B, and 302C are running rails 304A, 304B, 306A, and 306B. Running rails 304A and 304B are positioned at a top end 310 of the bailer and running rails 306A and 306B are positioned near a bottom end of the bailer 320. Depending on the embodiment, the length of the running rails 304A, 304B, 306A, and 306B may be reduced or lengthened and/or relocated to another location on the bailer. It to be appreciated that there may be counterpart running rails (not shown) that are respectively opposite on the bailer 300 to running rails 304A, 304B, 306A, and 306B.

Figure 4:
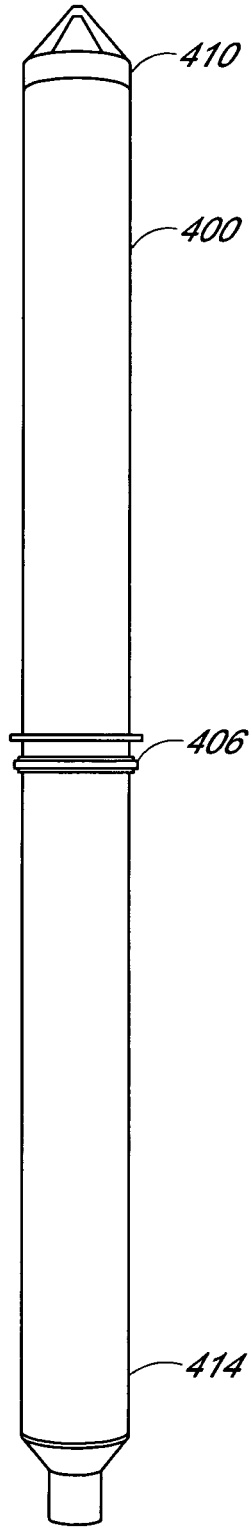
FIG. 4 is an elevation view of a bailer according to one embodiment of the invention that has a concentric ring.

FIG. 4 is an elevational view of a bailer 400. The bailer 400 includes a collar 406. In one embodiment of the invention, the collar 406 is concentrically positioned about the bailer 400 near a mid-point of the bailer 400. The collar 406 may be integrated with the bailer 400 during manufacture or affixed after the manufacture of the bailer 400. If integrated after manufacture, in one embodiment, the collar 406 is slid around either a top end 410 or a bottom end 414 of the bailer 400 and affixed by tension/friction. In one embodiment, the collar 406 is comprised of two or more interlocking pieces that may fastened about the bailer 400 at either a location desired by a user or at a predesignated location identified via marking by the manufacturer. It is to be appreciated that more than one collar may be provided on the bailer 400. The collar prevents a substantial portion of the housing of the bailer 400 from contacting a side of a well during use.

Figure 5:
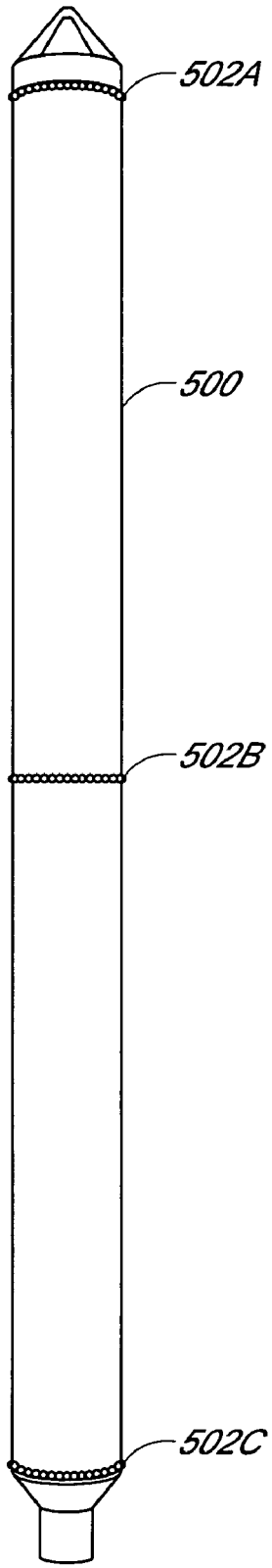
FIG. 5 is an elevation view of a bailer according to one embodiment of the invention that has three concentric rings.

FIG. 5 is an elevational view of a bailer 500. The bailer 500 includes rings 502A, 502B, and 502C that are concentrically positioned about the bailer 500. The rings 502A, 502B, and 502C may be integrated with the bailer 400 during manufacture or affixed after the manufacture of the bailer 500. If integrated after manufacture, in one embodiment, the rings 502A, 502B, and 502C may be slid around either a top end 410 or a bottom end 414 of the bailer 500. In one embodiment, the rings 502A, 502B, and 502C are each comprised of two or more interlocking pieces that may fastened about the bailer either at a location desired by a user or at a predesignated location identified via marking by the manufacturer. In one embodiment, the rings 502A, 502B, and 502C are each comprised of a one piece ring that may be fastened about the bailer either at a location desired by a user or at a pre-designated location identified via marking by the manufacturer. It is to be appreciated that more than three rings may be provided on the bailer 500. The rings prevent a substantial portion of the housing of the bailer 500 from contacting a side of a well during use. In one embodiment, the number of rings on the bailer 400 or the bailer 500 is selected from the group comprising: 1, 2, 3, 4, 5, 6, 7, 8, 9, 10, 11, 12, 13, 14, 15, 16, 17, 18, 19, 20, 21, 22, 23, 24, 25, . . . , 100.

Figure 6:
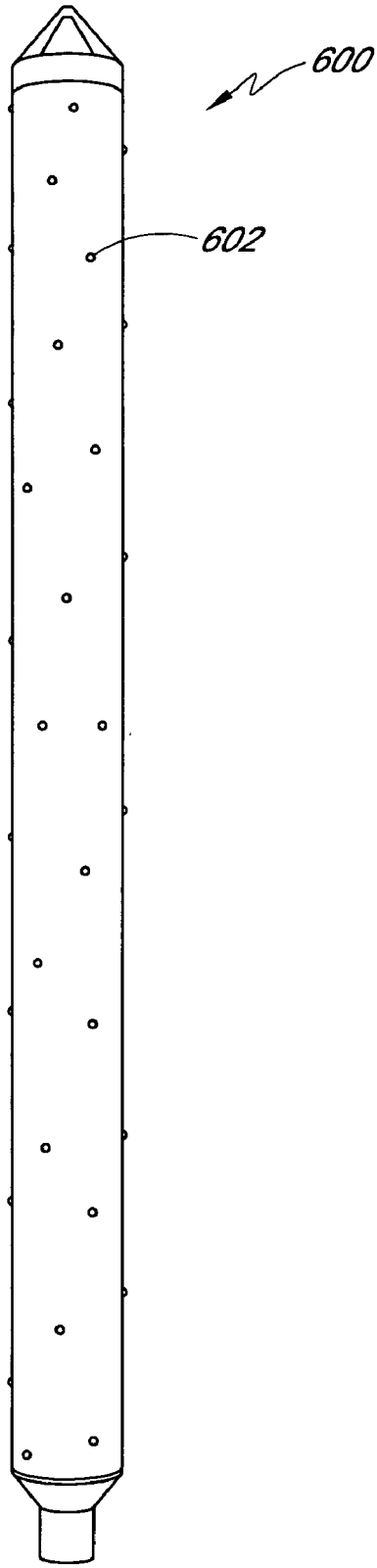
FIG. 6 is an elevation view of a bailer according to one embodiment of the invention that has a plurality of protrusions.

FIG. 6 is an elevational view of a bailer 600. The bailer 600 may include a plurality of protrusions. It is noted that although the protrusions shown in FIG. 6 are spherical, it is to be appreciated that other shapes may be used, e.g., pyramidal protrusions, cubical protrusions, and/or rectangular protrusions. The number of protrusions on the bailer 600 is selected from the group comprising: 1, 2, 3, 4, 5, 6, 7, 8, 9, 10, 11, 12, 13, 14, 15, 16, 17, 18, 19, 20, 21, 22, 23, 24, 25, . . . , 1000.

In one embodiment, the texture of the bailer may include concave or inward depressions. These depressions will cause a reduction in the potential contact surface area of the bailer 600 with a well wall. The depressions may be included in the housing of any of the bailers shown in FIGS. 1-6 or another configuration. Furthermore, in certain embodiments, the runners described with respect to FIGS. 2 and 3, the rings described with respect to FIGS. 4 and 5, and the protrusions of FIG. 6, or elements thereof, could be integrated together with respect to a particular bailer. It is to be appreciated that that each of the bailers shown in FIGS. 1-6 include a mechanism (now shown) for holding the stored well water within the bailers.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The features, textures, and shapes discussed above may be an integral part of the bailer or alternatively, they can be connected to the bailer by either the manufacturer or an end-user. The scope of the invention is indicated by the appended claims rather than by the foregoing description. All changes which come within the meaning and range of equivalency of the claims are to be embraced within their scope.

What is claimed is:

1. A water well bailer, comprising:

a tubular housing composed at least in part of a polymer, which includes copolymers, the housing adapted to store a sample of well water; and a texture on the housing, wherein the texture of the bailer provides a surface area of the bailer that does not stick to a wall of a water well during incidental contact during descent of the bailer in the water well, wherein the texture comprises at least one ring concentrically surrounding at least a portion of the tubular housing, the ring being configured to prevent a substantial portion of the outer surface of the housing from contacting the side of the water well during use, wherein the ring forms a pivot point for the bailer, and wherein the ring is configured to be mated with the housing subsequent to the manufacture of the bailer.

2. The water well bailer of claim 1, wherein the ring is configured to be mated with the housing by sliding the ring over one end of the housing.

3. The water well bailer of claim 2, wherein the ring is mated with the housing by frictional forces.

4. The water well bailer of claim 2, wherein the ring is mated with the housing by an adhesive.

5. The water well bailer of claim 2, wherein the ring has a substantially uniform outer surface.

6. The water well bailer of claim 2, wherein the ring has a non-uniform outer surface.

7. The water well bailer of claim 1, wherein the ring is open-ended at both ends.

8. A water well bailer, comprising:

a tubular housing composed at least in part of a polymer, which includes copolymers, the housing adapted to store a sample of well water; and a texture on the housing, wherein the texture of the bailer provides a surface area of the bailer that does not stick to a wall of a water well during incidental contact during descent of the bailer in the water well, wherein the texture comprises at least one ring concentrically surrounding at least a portion of the tubular housing, the ring being configured to prevent a substantial portion of the outer surface of the housing from contacting the side of the water well during use, and wherein the ring is configured to be mated with the housing subsequent to the manufacture of the tubular housing;

wherein the ring is configured to be mated with the housing by sliding the ring over one end of the housing;

wherein the ring comprises a plurality of protrusions of one or more geometric shapes.

9. A water well bailer, comprising:

a non-metallic tubular housing configured to store within the housing a sample of well water; and at least one ring concentrically surrounding at least a portion of the tubular housing, the ring being configured to prevent a substantial portion of the outer surface of the housing from contacting a side of a water well during incidental contact during descent of the bailer in the water well, the ring being configured to be mated with the housing subsequent to the manufacture of the bailer, the ring forming a pivot point for the bailer.

10. The water well bailer of claim 9, wherein the ring is configured to be mated with the housing by sliding the ring over one end of the housing.

11. The water well bailer of claim 10, wherein the ring is mated with the housing by frictional forces.

12. The water well bailer of claim 10, wherein the ring is mated with the housing by an adhesive.

13. The water well bailer of claim 9, wherein the ring has a substantially uniform outer surface.

14. The water well bailer of claim 9, wherein the ring has a non-uniform outer surface.

15. The water well bailer of claim 9, wherein the housing is manufactured from a material selected from the group consisting of: a polymer, resin or plastic; and a composite material, filled or reinforced with various fibers.

16. A water well bailer, comprising:

a non-metallic tubular housing configured to store within the housing a sample of well water; and at least one ring concentrically surrounding at least a portion of the tubular housing, the ring being configured to prevent a substantial portion of the outer surface of the housing from contacting a side of a water well during incidental contact during descent of the bailer in the water well, the ring being configured to be mated with the housing subsequent to the manufacture of the tubular housing;

wherein the ring comprises a plurality of protrusions of any geometric shape.

17. A method of modifying a well water bailer, the method comprising:

providing a non-metallic tubular water well bailer configured to store within the bailer a sample of well water; and concentrically affixing, subsequent to the manufacture of the bailer, at least one ring to at least a portion of the bailer, the ring being configured to prevent a substantial portion of the outer surface of the bailer from contacting a side of a well during incidental contact of the ring with the water well during a descent of the bailer into the water well, the ring forming a pivot point for the bailer.

18. The method of claim 17, wherein concentrically affixing the ring comprises sliding the ring over one end of the bailer.

19. The water well bailer of claim 17, wherein the bailer is manufactured from a material selected from the group consisting of: a polymer; and a composite material.

20. A method of modifying a well water bailer, the method comprising:

providing a non-metallic tubular water well bailer configured to store within the bailer a sample of well water; and concentrically affixing, subsequent to the manufacture of the bailer, at least one ring to at least a portion of the bailer, the ring being configured to prevent a substantial portion of the outer surface of the bailer from contacting a side of a well during incidental contact of the ring with the water well during a descent of the bailer into the water well;

wherein concentrically affixing the ring comprises mating at least two elements around a portion of the bailer, wherein the two elements when mated form the ring.

21. A method of modifying a well water bailer, the method comprising:

providing a non-metallic tubular water well bailer configured to store within the bailer a sample of well water; and concentrically affixing, subsequent to the manufacture of the bailer, at least one ring to at least a portion of the bailer, the ring being configured to prevent a substantial portion of the outer surface of the bailer from contacting a side of a well during incidental contact of the ring with the water well during a descent of the bailer into the water well;

wherein concentrically affixing the ring comprises sliding the ring over one end of the bailer until the ring is positioned near a midpoint of the bailer.

22. A water well bailer, comprising:

a tubular housing configured to store within the housing a sample of well water, the housing being manufactured from a material selected from the group consisting of: a polymer; and a composite material; and at least one ring concentrically surrounding at least a portion of the tubular housing, the ring being configured to prevent a substantial portion of the outer surface of the housing from contacting a side of a well during incidental contact of the ring with well during descent of the bailer, the ring being configured to be mated with the housing subsequent to the manufacture of the bailer, the ring forming a pivot point for the bailer.

23. A water well bailer, comprising:

a non-metallic and low-density tubular housing for storing within the housing a sample of well water; and a texture on the housing, wherein the texture of the housing provides a surface of the bailer such that the bailer does not stick to the wall because during descent the adhesive and cohesive forces acting between the bailer and well wall are not greater than the gravitational forces acting upon the bailer, wherein the texture comprises at least one ring concentrically surrounding at least a portion of the tubular housing, the ring being configured to prevent a substantial portion of the outer surface of the housing from contacting the side of the water well during incidental contact of the ring with the water well during a descent of the bailer into the water well, and wherein the ring is configured to be mated with the housing subsequent to the manufacture of the bailer, the ring forming a pivot point for the bailer.

24. The water well bailer of claim 23, wherein the housing is manufactured from a material selected from the group consisting of: a polymer; and a composite material.

25. A water well bailer, comprising:

a tubular housing composed of a low-density, non-cellulosic, and non-metallic material for storing within the housing a sample of well water; and a texture on the housing, wherein texture of the bailer provides a surface area of the bailer that does not stick to a wall of a water well during incidental contact during descent of the bailer in the water well, wherein the texture comprises at least one ring concentrically surrounding at least a portion of the tubular housing, and wherein the ring is configured to be mated with the housing subsequent to the manufacture of the bailer, the ring forming a pivot point for the bailer.

26. The water well bailer of claim 25, wherein the texture comprises at least one ring concentrically surrounding at least a portion of the tubular housing, the ring being configured to prevent a substantial portion of the outer surface of the housing from contacting the side of the water well during use.

27. The water well bailer of claim 26, wherein the ring is integrally manufactured with the tubular housing.

28. The water well bailer of claim 26, wherein the ring is configured to be mated with the housing subsequent to the manufacture of the tubular housing.

* * * * *